United States Patent [19]

Reed et al.

[11] Patent Number: 4,533,427

[45] Date of Patent: Aug. 6, 1985

[54] DEVICE FOR MAKING GROOVES IN CIGARETTE FILTERS

[75] Inventors: Steven P. Reed, Felton; Erik I. Naslund, Los Gatos, both of Calif.

[73] Assignee: Brown & Williamson Tobacco Corporation, Louisville, Ky.

[21] Appl. No.: 631,961

[22] Filed: Jul. 18, 1984

[51] Int. Cl.[3] ..... A24D 3/04

[52] U.S. Cl. ..... 156/500; 156/219; 156/242; 156/581; 156/583.1; 264/293; 425/385; 425/392; 425/394; 493/42; 493/43

[58] Field of Search ..... 156/209, 219, 220, 441, 156/500, 553, 245, 581, 242, 583.1; 264/284, 293; 425/383, 385, 392, 394; 493/42, 43; 101/4–6, 8, 11, 22–25, 36–37

[56] References Cited

U.S. PATENT DOCUMENTS

| | | | |
|---|---|---|---|
| 2,703,047 | 3/1955 | Schever et al. | 264/293 X |
| 3,026,792 | 3/1962 | Miskel et al. | 101/11 |
| 4,075,936 | 2/1978 | Berger | 493/43 |
| 4,324,540 | 4/1982 | Sexstone et al. | 493/42 X |
| 4,436,517 | 3/1984 | Lebet | 493/43 X |
| 4,480,982 | 11/1984 | Sexstone et al. | 425/392 X |

*Primary Examiner*—David Simmons

*Attorney, Agent, or Firm*—Charles G. Lamb

[57] ABSTRACT

An apparatus for forming grooves in the peripheral surface of a filter rod includes an endless conveyor device having a generally horizontal top conveyor flight which intermittently moves the filter rods through the apparatus. The endless conveyor device has a plurality of filter rod receiving pockets at spaced apart intervals along its length. The pockets in the horizontal top conveyor flight hold cigarette filters to be grooved at predetermined spaced apart intervals as the endless conveyor device moves the filter rods through the apparatus. A plurality of pairs of articulated grooving fingers are located generally below the horizontal top conveyor flight at predetermined spaced intervals along the top flight, and a plurality of pairs of articulated grooving fingers are located generally above the horizontal top flight at predetermined spaced intervals along the top flight. A groove forming blade is attached to the tip of each finger of each pair of fingers. As the fingers of each pair of articulated fingers move toward each other the groove forming blades embed in the filter rods carried on the horizontal top conveyor flight of the conveyor device thereby forming the grooves in the filter rods.

10 Claims, 5 Drawing Figures

DEVICE FOR MAKING GROOVES IN CIGARETTE FILTERS

BACKGROUND OF THE INVENTION

1. Field of the Invention

The present invention relates to the manufacture of filters for cigarettes and more particularly to the making of grooves in cigarette filters.

2. Description of the Prior Art

Cigarettes are often provided with filter devices at one end remove materials from the smoke stream coming from the tobacco column during smoking. These filters, which are attached to the tobacco column, come in many different sizes, shapes and forms. Some filters which are presently on the market include grooves. In some filter constructions, the grooves facilitate the by-passing of smoke around the filter. In other filter constructions, the grooves provide a channel for mixing ventilating air and by-passed smoke. In still other constructions, the grooves provide a path for only ventilating air to pass therealong without mixing with smoke.

In the manufacture of grooved cigarette filters, many suggestions have been made for making the grooves in the filter rod. U.S. Pat. No. 3,804,695 shows the use of a pair of parallel rollers in pressure engagement defining a nip therebetween wherein one of the rollers is provided with a circumferential or a helical grooved surface so that, as a filter rod passes therethrough, permanent depressions are made along the longitudinal dimensions of the filter rod. U.S. Pat. No. 4,075,936 shows a die having cam manipulated radially reciprocating pins that periodically move into and out of the longitudinal path of a filter rod as the filter rod tow moves past. When the pins extend into the path of the tow they impress grooves in the filter rod. U.S. Pat. No. 4,149,546 shows an apparatus for making grooves in a cigarette filter wherein a filter rod is moved in an arcuate path transverse to a heated forming means, the filter rod being supported and conveyed for relative movement at the periphery of a drum-shaped inner rotor and the forming means compresses a heated arcuate outer strator element or elements projecting inwardly toward the rotor. U.S. Pat. No. 4,324,540 teaches an apparatus for making grooves in filters which comprises a plurality of fixed position groove forming blades and a filter plug conveying device located next to the groove forming blades. Cigarette filters to be grooved are moved along the path between the conveyor device and blades, rolling past the blades whereupon grooves are formed in the filters by the blades.

SUMMARY OF THE INVENTION

The present invention provides an apparatus for making grooves in cigarette filter rods. The present invention further provides a device for concurrently forming a plurality of elongated grooves in the peripheral surface of a filter rod.

More particularly, the present invention provides an apparatus for making grooves in the peripheral surface of a filter rod comprising endless conveyor means having a generally horizontal top flight for intermittently moving filter rods through the apparatus, means associated with the endless conveyor means for holding the filter rods at predetermined spaced apart intervals on the horizontal top flight of the endless conveyor means, and groove forming means disposed at the top flight of the endless conveyor means for forming grooves in the peripheral surface of the filter rods in the holding means.

BRIEF DESCRIPTION OF THE DRAWINGS

A more complete understanding of the present invention will be obtained upon reference to the following description in conjunction with the accompanying drawings in which like numerals refer to like parts and wherein.

DESCRIPTION OF THE PREFERRED EMBODIMENTS

Figure 1:
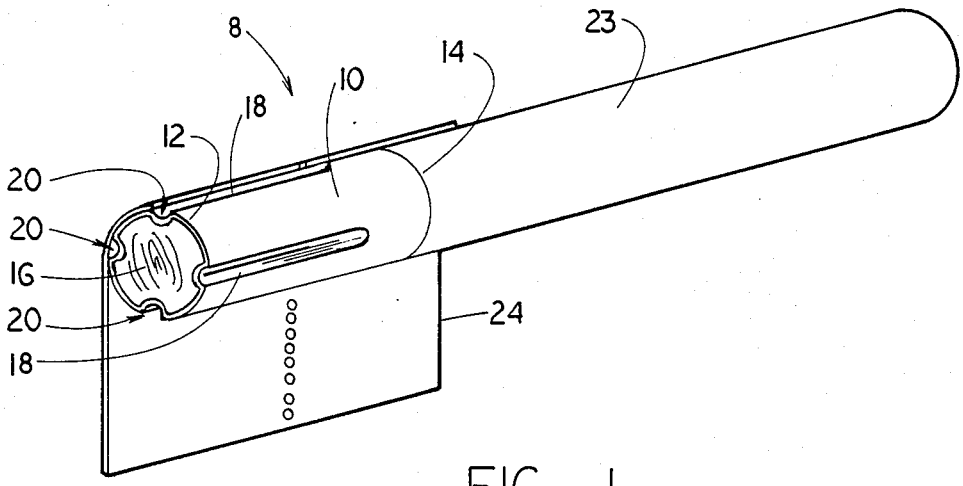
FIG. 1 is a perspective view of a cigarette including a filter rod, the apparatus of the present invention being capable of manufacturing the filter rod.

Novel cigarette filters 8 of the type illustrated in FIG. 1 comprise a generally cylindrically shaped filter rod 10 fabricated of an air and smoke permeable material and a circumscribing wrapper 12 fabricated of an air and smoke impermeable material. The wrapper 12 extends longitudinally of the filter rod 10 from end 14 of the filter rod to the other end 16 thereof so that the filter rod ends 14 and 16 are in mutual flowthrough relationship. The filter 8 includes a plurality of grooves 18 formed in the wrapper 12 and embedded into the filter rod 10. Each of the grooves 18 is open, as designated by the number 20, at the mouth end 16 of the filter rod 10 and extends therefrom in a generally longitudinal direction of the filter rod 10 for a distance less than the length of the filter rod 10. The grooves 18 are illustrated as being four in number, and equally spaced from each other about the circumference of the filter rod 10. The filter rod 10 is attached to a tobacco column 23 by means of an air permeable tipping material 24 which circumscribes the filter rod and overlaps a portion of the tobacco column 23 in a manner known in the art to form a filtered cigarette. In FIG. 1, the tipping material is shown in a partially unwrapped position to more clearly show details of the wrapped filter rod.

Figure 2:
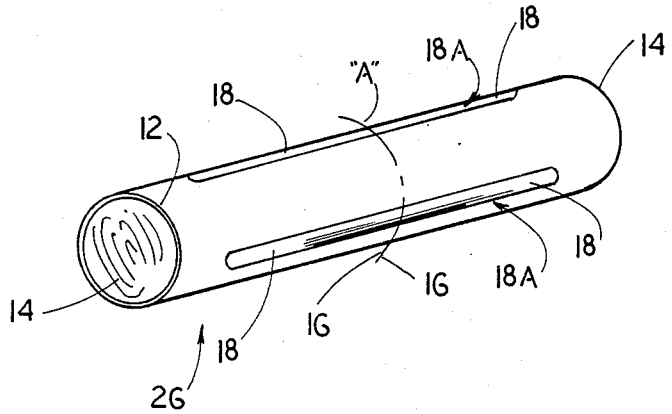
FIG. 2 is a perspective view of a filter tow from which the representative filter rod of FIG. 1 is made, the apparatus of the present invention being capable of manufacturing the filter tow.

Now with reference to FIG. 2, as a manufacturing expedient, individual filter rods 10 are manufactured from a filter tow 26. The filter tow 26 is of a generally cylindrical shape and is as long as a preselected number of filter rods 10. The filter tow 26 is formed with longitudinally extending grooves 18A, each of which is twice as long as a groove 18 in the filter rod 10. The filter rod 26 is severed, generally transversely to the longitudinal centerline of the filter tow 26, at intervals corresponding to the desired filter rod 10 length, into individual filter rods 10. As illustrated, the filter tow 26 is severed at location (denoted by the dashed line "A") at the transverse centerline of the double length grooves 18A. Thus in the illustration of FIG. 2, two individual filter rods 10 are produced by severing the filter tow 26 at the dashed line "A".

Figure 3:
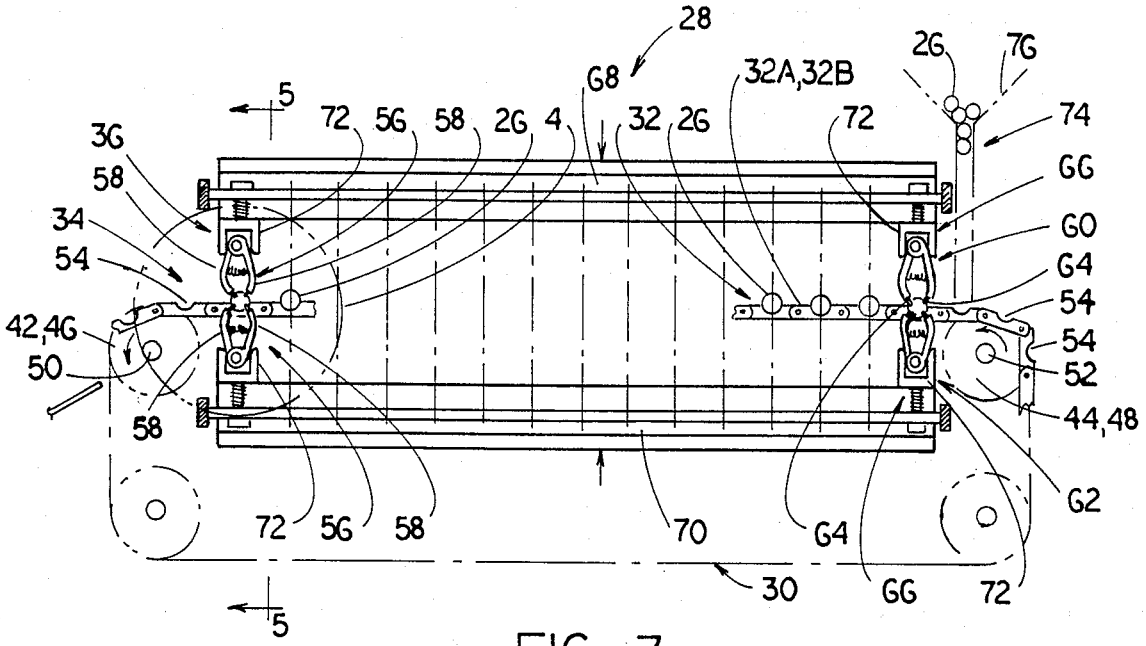
FIG. 3 is a side view of an apparatus embodying the present invention in a groove forming position.
Figure 4:
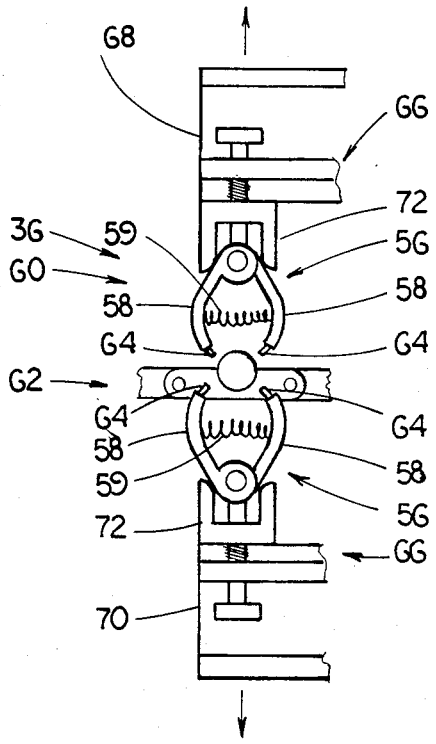
FIG. 4 is a side view of a portion of the apparatus enclosed by the phantom circle 4 in FIG. 3 illustrating a dwell position.

FIGS. 3 and 4 show a device, generally denoted as the numeral 28, for making grooves 18 in the filter rod 10 of FIG. 1. The following discussion will speak to forming double length grooves 18A in the filter tow 26, but it should be clearly understood that the apparatus 28 could just as readily be used to form grooves 18 in individual filter rods 10 essentially without modification.

Referring to FIGS. 3 and 4, the groove making apparatus 28 comprises an endless conveyor means, generally denoted as the numeral 30 which has a generally horizontal top flight 32. Filter tow holding means, generally denoted by the numeral 34, are associated with the endless conveyor means 30 for holding the filter tows 26 at predetermined spaced apart intervals along the horizontal top flight 32 of the endless conveyor means 30. Grooving means, generally denoted as the numeral 36, located between the ends of the horizontal top flight 32 of the endless conveyor means 30 form grooves in the filter tows 26 located on the top horizontal conveyor flight 32.

Figure 5:
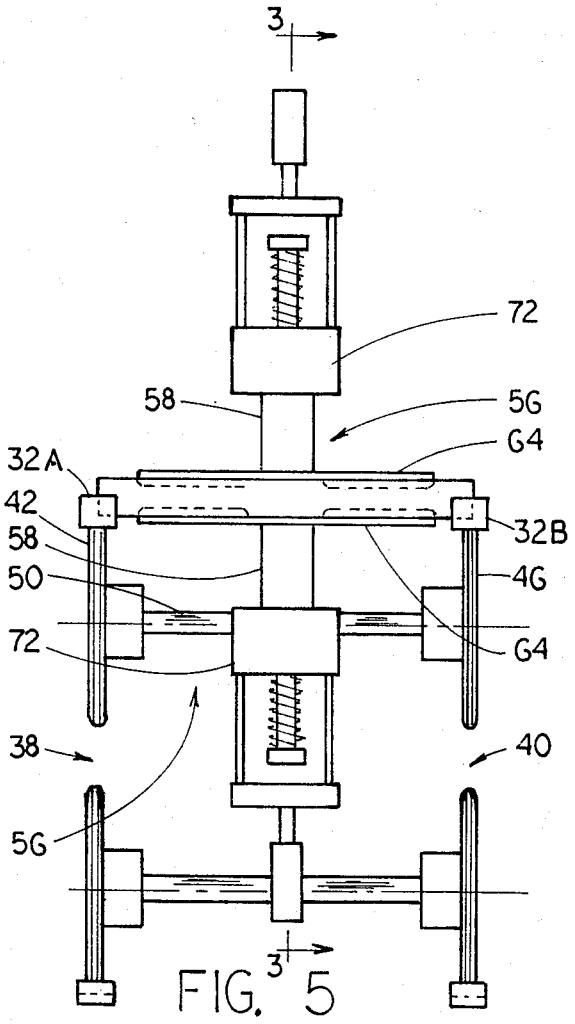
FIG. 5 is a cross-sectional view of the apparatus of FIG. 3 as viewed in the direction of arrows 5—5 in FIG. 3.

With continued reference to FIG. 3 and additional reference to FIG. 5, the endless conveyor means 30 comprises a pair of endless chain conveyor devices 38 and 40 located in spaced apart, side-by-side relationship. The endless chain conveyor 38 has a head sprocket 42 and a tail sprocket 44 and similarly, the endless chain conveyor 40 has a head sprocket 46 and a tail sprocket 48. The head sprockets 42 and 46 are mounted to a common shaft 50, and the tail sprockets 44 and 48 are mounted to a common shaft 52. As illustrated, the endless chain conveyor device 38 has a top horizontal flight 32A and the endless chain conveyor device 40 has a top horizontal flight 32B. The top horizontal flights 32A and 32B are in spaced apart, generally parallel relationship with the space therebetween being less than the length of a filter tow 26.

As can be best seen in FIG. 3, the filter tow holding means 34 associated with the endless conveyor means 30 includes a plurality of pockets 54 formed in the endless chains of each of the endless chain conveyors devices 38 and 40. The pockets 54 are at spaced intervals along the entire length or loop of the conveyor chains of the chain conveyors 38 and 40. The number of pockets 54 in the endless chain of the endless chain conveyor device 38 is equal to the number of pockets 54 in the endless chain conveyor device 40. Each pocket 54 in the endless chain conveyor device 40 moving in the horizontal top flight 32A is in alignment with a different one of the pockets 54 in the endless chain of the endless chain conveyor device 40 moving in the horizontal top flight 32B across the space between the horizontal top flights 32A and 32B.

With reference to FIGS. 3 through 5, the grooving means 36 is illustrated as including a plurality of pairs 56 of articulated grooving fingers 58 arranged in two rows 60 and 62 generally along the horizontal top flight 32 of the endless conveyor means 30. The first row 60 includes a plurality of pairs 56 of articulated fingers 58 located generally between and above the top horizontal flights 32A and 32B of the endless chain conveyor devices 38 and 40, respectively, at predetermined spaced apart intervals therealong. The second row 62 includes a plurality of pairs 56 of articulated fingers 58 located generally between and below the top horizontal flights 32A and 32B of the endless chain conveyor devices 38 and 40, respectively, at predetermined spaced apart intervals therealong. As shown, each pair 56 of articulated grooving fingers 58 in the first row 60 is generally in alignment with a different one of the pairs 56 of articulated grooving fingers 58 in the second row 62. The interval between adjacent pairs 56 of articulated grooving fingers 58 in the row 60 and in the row 62 is generally equal to the interval between adjacent filter tow receiving pockets 54 in the chain of the endless chain device 38 and the endless chain device 40.

Each finger 58 of each pair 56 has a groove forming blade 64 affixed to its distal end or tip. Each groove forming blade 64 has substantially the same length and width dimensions as the grooves 18A to be formed in the peripheral surface of the filter tow 26. The groove forming blade 64 is adapted to be embedded into the peripheral surface of the filter tow 26 as the fingers 58 of each pair 56 move toward each other, thus, forming a groove 18A in the filter tow 26. The groove forming fingers 58 of each pair 56 include a compression spring 59 therebetween which biases the fingers 58 of each pair 56 to pivot away from each other.

It is foreseeable that the groove forming blades 64 be heated by, for example, electrical resistance heating means if the material of the filter tow 26 has such a high modulus of elasticity that it will not otherwise take a permanent set when the groove forming blades 64 are implanted in the peripheral surface of the filter rod 26.

With reference to FIGS. 3 through 5, the apparatus 28 further includes means, generally denoted as the numeral 66, for activating the pairs 60 of fingers 58 between a groove forming position (illustrated in FIG. 3) and a dwell position (illustrated in FIG. 4). When in the groove forming position, the distal ends of the fingers 58 of each pair 56 are moved toward each other to a position whereat the groove forming blades 64 at the distal ends of the fingers 58 are embedded in the peripheral surface of the filter tow 26. When in the dwell position the distal ends of the fingers 58 of each pair 56 are moved away from each other to a position whereat the groove forming blades 64 at the distal ends of the fingers 58 are retracted from the filter tow 26. The finger activating means comprises an upper platen 68 and a lower platen 70. The upper platen 68 is located in general parallel relationship to and above the top conveyor chain flights 32A and 32B. The lower platen 70 is located in general parallel relationship to and below the top conveyor chain flights 32A and 32B. The upper and lower platens 68 and 70 are moved for movement in a generally vertical direction toward and away from each other as indicated by the arrows in FIGS. 3 and 4, respectively. A plurality of sleeve members 72 are attached to the upper and lower platens 68 and 70 for movement therewith. As shown, a plurality of sleeve members 72 are attached to the upper platen 68 at spaced apart intervals corresponding to the interval between adjacent pairs 56 of fingers 58 in the first row 60, a plurality of sleeve members 72 are attached to the lower platen 70 at spaced apart intervals corresponding to the interval between adjacent pairs 56 of fingers 58 in the second row 62. Each one of the sleeve members 72 on the upper platen 68 is in alignment with a different one of the pairs 56 of articulated fingers 58 in the first row 60, and each one of the sleeve members 72 on the lower platen 70 is in alignment with a different one of the pairs 56 of the articulated fingers 58 in the second row 62. As the upper and lower platens 68 and 70 move toward each other, each of the sleeve members 72 moves over the proximal end of the pairs 56 of fingers 58 aligned therewith. As a sleeve member 72 receives a pair 56 of fingers 58, the interior wall surface of the sleeve member 72 contacts and slides along each finger 58 forcing the fingers 58 to pivot about their hinged proximal ends toward each other moving the distal ends of the fingers 58 toward each other and causing the groove forming blades 64 attached to the distal ends to embed into the periphery of the filter tow 26 and form grooves 18A therein. As the upper and lower platens 68 and 70 move away from each other, each of the sleeve members 72 moves to a position away from the proximal end of the pair 56 of fingers 58 aligned therewith such that the interior wall surface of the sleeve member 72 disengages from contact with the fingers 58. As the sleeve member 72 disengages from contact with the fingers 58, the spring 59 between the fingers 58 of a pair 56 forces the fingers 58 to pivot about their hinged proximal end away from each other moving the distal ends of the fingers 58 away from each other and causing the groove forming blade 64 attached to the distal ends to retract from the filter tow 26.

The apparatus 28 also includes loading means 74 for depositing a filter tow to be grooved in successive pockets 54 of the top horizontal flights 32A and 32B of the chains of the endless chain conveyor devices 38 and 40 as the pockets successively pass over the tail sprockets 44 and 48 at one end of the apparatus 28. As shown, the loading means comprises a hopper 76 located with its open discharge end located over the top horizontal flights 32A and 32B next to the tail sprockets 44 and 48.

In operation, the endless chain conveyor devices 38 and 40 move through the apparatus 28 until all of the pockets 54 of the top horizontal flights 32A and 32B of the pair of endless chain conveyor devices contain filter tows 26 to be grooved. When this event occurs, the endless conveyor devices 38 and 40 are stopped with each set of aligned pockets 54 of the chains of endless chain conveyor devices 38 and 40 in alignment with a different pair 56 of grooving fingers 58 in the first row 60 and with a different pair 56 of grooving fingers 58 in the second row 62. While the endless conveyor devices 38 and 40 are in the dwell mode, the upper and lower platens 68 and 70 are activated to move toward each other causing the sleeve members 72 to slide over aligned pairs 56 of grooving fingers 58, thus, forcing the fingers 58 of each pair 56 toward each other embedding the groove forming blades 64 attached to the distal ends of the fingers 58 into the filter tows 26 aligned with the finger pairs 56. The upper and lower platens 68 and 70 are then activated to move away from each other moving the sleeve members 72 away from the proximal ends of the pairs 56 of grooving fingers 58 allowing the fingers 58 of each pair 56 to move away from each other under the influence of the spring means 59, thus, extracting the grooving blades 64 from the filter tow 26. After the grooving blades 64 have been extracted from the filter tows 26, the endless chain conveyor devices 38 and 40 again are caused to move and exit the apparatus at the end thereof whereat the head sprockets 42 and 46 are located. As the endless chain conveyor devices 38 and 40 pass over the head sprockets 42 and 46, the filter tows 26 fall out of the pockets 54 by gravity.

After the grooved filter tows 26 exit the apparatus 28, they are conveyed to another work station (not shown) where they are severed into individual filter rods 10 as discussed above.

The means for starting and stopping the endless conveyor devices 38 and 40, and for activating the upper and lower platens 68 and 70 in timed sequence therewith are well known to the art and will, therefore, not be discussed in detail. Such means include, for example, pneumatic or hydraulic cylinders with solenoid valves and limit switches, motor driven rack and pinion arrangements, and other means known to the art.

It should be understood that the apparatus 28 can be used to form grooves 18 in filter rods 10 essentially without modification and, therefore, the term filter rod is used in a generic sense in the appended claims to mean either individual filter rods 10 or filter tow 26 from which individual filter rods 10 are cut after the apparatus 28 of the present invention has formed grooves therein.

The foregoing detailed description is given primarily for clearness of understanding and no unnecessary limitations should be understood therefrom for modifications will become obvious to those skilled in the art upon reading this disclosure and may be made without departing from the spirit of the invention or scope of the appended claims.

What is claimed is:

1. An apparatus for forming grooves in filter rods comprising:

endless conveyor means having a generally horizontal top flight for intermittently moving filter rods through the apparatus;

means associated with the endless conveyor means for holding the filter rods at predetermined spaced apart intervals on the horizontal top flight of the endless conveyor means; and, groove forming means disposed at the top flight of the endless conveyor means for forming grooves in the filter rods in the holding means, the groove forming means including at least one pair of articulated grooving fingers located generally below the horizontal top flight and at least one pair of articulated grooving fingers located generally above the horizontal top flight.

2. The apparatus of claim 1, wherein the filter rod holding means comprises means defining a plurality of pockets spaced apart at predetermined intervals along the endless conveyor means.

3. The apparatus of claim 1, wherein each finger of each pair of articulated grooving fingers comprises a groove forming blade having the dimensions of the groove to be formed in the filter rod affixed to its tip, the groove forming blade being adapted to embed into the peripheral surface of the filter rod.

4. The apparatus of claim 1, comprising:

a plurality of pairs of articulated grooving fingers located generally below the horizontal top flight at predetermined spaced intervals along the horizontal top flight; and, a plurality of pairs of articulated grooving fingers located generally above the horizontal top flight at predetermined spaced intervals along the horizontal top flight.

5. The apparatus of claim 4, wherein each pair of articulated grooving fingers located above the horizontal top flight is in general vertical alignment with a different one of the pairs of articulated grooving fingers located below the horizontal top flight.

6. The apparatus of claim 4, wherein the predetermined spaced interval between pairs of articulated grooving fingers along the horizontal top flight generally equals the predetermined spaced intervals between filter rods on the horizontal top flight.

7. The apparatus of claim 4, wherein:

the filter rod holding means comprises means defining a plurality of pockets spaced apart at predetermined intervals along the endless conveyor means; and, the predetermined spaced interval between pairs of articulated grooving fingers along the horizontal top flight generally equals the predetermined spaced intervals between the pockets.

8. The apparatus of claim 4, further comprising means for activating the articulated fingers of each pair in a direction generally toward each other to a groove forming position and away from each other to a dwell position.

9. The apparatus of claim 8, wherein the means for activating the fingers comprises:

a plurality of sleeve members located at predetermined intervals adjacent the pairs of articulated groove forming fingers below the horizontal top flight, each of the sleeve members being in alignment with a different one of the pairs of grooving fingers; and, a plurality of sleeve members located at predetermined intervals adjacent the pairs of articulated groove forming fingers above the horizontal top flight, each of the sleeve members being in alignment with a different one of the pairs of grooving fingers.

10. The apparatus of claim 9, wherein the means for activating the fingers of each pair of comprises means for moving each sleeve member toward and away from the pair of fingers aligned therewith.

* * * * *